US010661575B2

(12) United States Patent
Goto et al.

(10) Patent No.: US 10,661,575 B2
(45) Date of Patent: May 26, 2020

(54) LIQUID CIRCULATION DEVICE AND LIQUID DISCHARGE DEVICE

(71) Applicant: TOSHIBA TEC KABUSHIKI KAISHA, Shinagawa-ku, Tokyo (JP)

(72) Inventors: Taiki Goto, Mishima Shizuoka (JP); Kazuhiro Hara, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/246,580

(22) Filed: Jan. 14, 2019

(65) Prior Publication Data

US 2019/0248148 A1 Aug. 15, 2019

(30) Foreign Application Priority Data

Feb. 15, 2018 (JP) ..... 2018-025164

(51) Int. Cl.

| | |
|---|---|
| ***B41J 29/38*** | (2006.01) |
| ***B41J 2/175*** | (2006.01) |
| ***B41J 2/18*** | (2006.01) |
| ***B41J 2/19*** | (2006.01) |

(52) U.S. Cl.

CPC ..... *B41J 2/17596* (2013.01); *B41J 2/175* (2013.01); *B41J 2/17506* (2013.01); *B41J 2/17566* (2013.01); *B41J 2/18* (2013.01); *B41J 2/19* (2013.01)

(58) Field of Classification Search

USPC ..... 347/6, 7, 85

See application file for complete search history.

(56) References Cited

U.S. PATENT DOCUMENTS 7,597,434 B2 10/2009 Nitta et al.
8,235,482 B2 * 8/2012 Katada ..... B41J 2/17556 347/19
9,221,265 B2 * 12/2015 Vodopivec ..... B41J 2/175

(Continued)

FOREIGN PATENT DOCUMENTS

CN 206703737 12/2017
JP 2017-13037 1/2017

OTHER PUBLICATIONS

Extended European Search Report for European Patent Application No. 19156669.4 dated Jul. 11, 2019.

*Primary Examiner* — Lam S Nguyen
(74) *Attorney, Agent, or Firm* — Amin, Turocy & Watson, LLP

(57) ABSTRACT

A liquid circulation device comprises a booster pump that draws liquid from a liquid replenishing tank to supply it to a liquid discharge head; a pressure reducing pump that collects the liquid from the liquid discharge head to supply it to the liquid replenishing tank; a buffer tank connected between the liquid discharge head and the booster pump and between the liquid discharge head and the pressure reducing pump, and into which the liquid flows; a pressure sensor that detects pressure in the buffer tank; and a processor that controls driving voltages of the booster pump and the pressure reducing pump based on a nozzle surface pressure of the liquid discharge head calculated based on pressure data detected by the pressure sensor, and determines whether the liquid is deficient based on the nozzle surface pressure, the driving voltages of the booster pump and the pressure reducing pump.

20 Claims, 7 Drawing Sheets

(56) References Cited

U.S. PATENT DOCUMENTS

| | | | | |
|---|---|---|---|---|
| 2008/0079759 | A1* | 4/2008 | Nagashima | B41J 2/175 347/10 |
| 2009/0244131 | A1* | 10/2009 | Shibata | B41J 2/17556 347/9 |
| 2012/0033003 | A1* | 2/2012 | Tanaka | B41J 2/175 347/6 |
| 2015/0085025 | A1* | 3/2015 | Ando | B41J 2/175 347/85 |
| 2019/0092034 | A1 | 3/2019 | Goto et al. | |

* cited by examiner

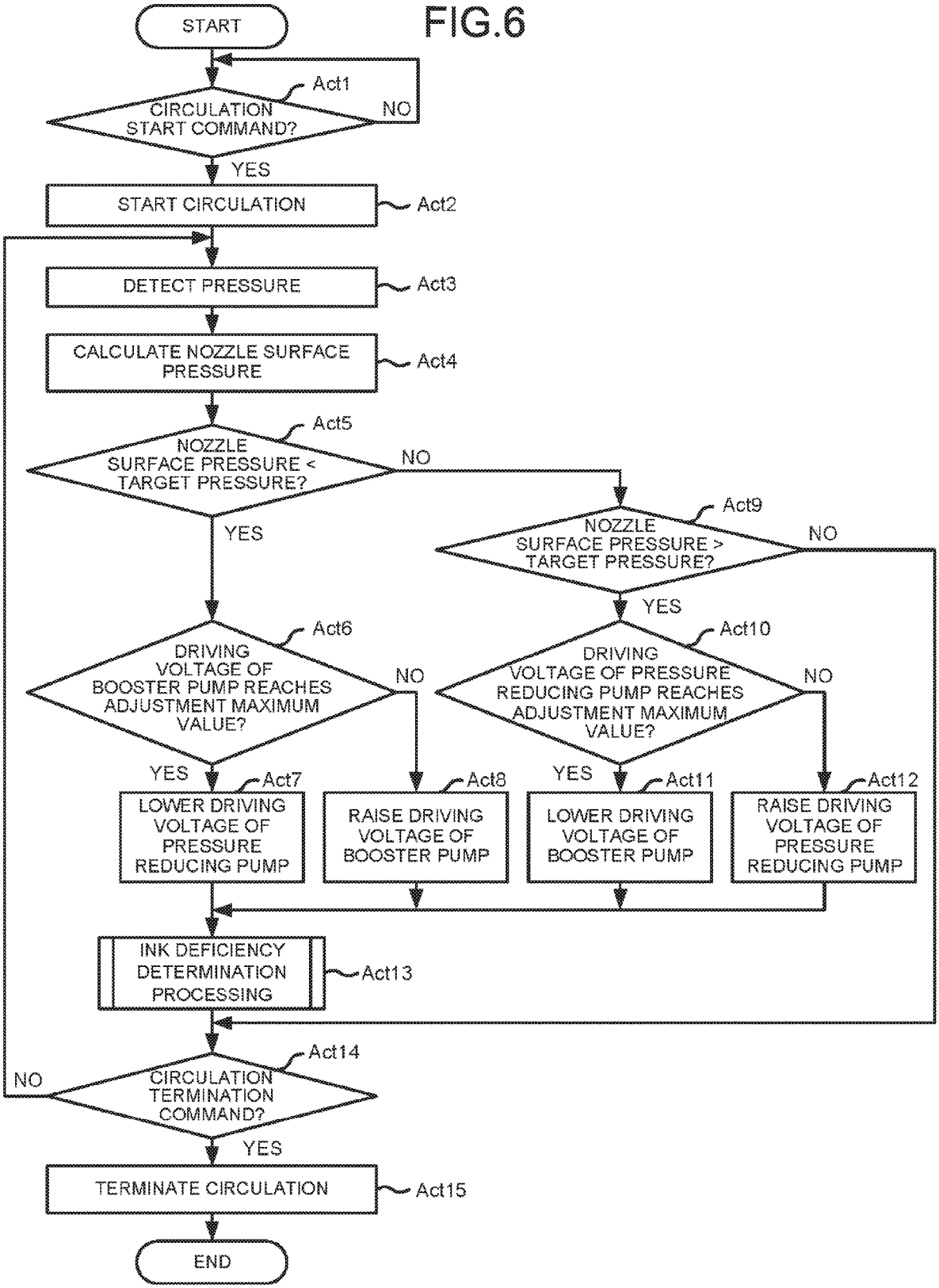
FIG.6
START
Act1
CIRCULATION START COMMAND?
NO
YES
START CIRCULATION
Act2
DETECT PRESSURE
Act3
CALCULATE NOZZLE SURFACE PRESSURE
Act4
Act5
NOZZLE SURFACE PRESSURE < TARGET PRESSURE?
NO
YES
Act9
NOZZLE SURFACE PRESSURE > TARGET PRESSURE?
NO
YES
Act6
DRIVING VOLTAGE OF BOOSTER PUMP REACHES ADJUSTMENT MAXIMUM VALUE?
NO
YES
Act10
DRIVING VOLTAGE OF PRESSURE REDUCING PUMP REACHES ADJUSTMENT MAXIMUM VALUE?
NO
YES
Act7
LOWER DRIVING VOLTAGE OF PRESSURE REDUCING PUMP
Act8
RAISE DRIVING VOLTAGE OF BOOSTER PUMP
YES
Act11
LOWER DRIVING VOLTAGE OF BOOSTER PUMP
Act12
RAISE DRIVING VOLTAGE OF PRESSURE REDUCING PUMP
INK DEFICIENCY DETERMINATION PROCESSING
Act13
Act14
NO
CIRCULATION TERMINATION COMMAND?
YES
TERMINATE CIRCULATION
Act15
END

LIQUID CIRCULATION DEVICE AND LIQUID DISCHARGE DEVICE

CROSS-REFERENCE TO RELATED APPLICATION

This application is based upon and claims the benefit of priority from Japanese Patent Application No. P2018-025164, filed on Feb. 15, 2018, the entire contents of which are incorporated herein by reference.

FIELD

Embodiments described herein relate generally to a liquid circulation device, a liquid discharge device, and methods related thereto.

BACKGROUND

A liquid discharge device includes a liquid discharge head (inkjet head) for discharging liquid (ink) and a liquid circulation device for circulating liquid in a circulation path including the liquid discharge head. The liquid circulation device replenishes ink from an ink replenishing tank to the liquid discharge head and collects the ink from the liquid discharge head to return it to the ink replenishing tank. The liquid circulation device has a pump that uses an actuator becoming deformed according to an applied voltage. The liquid circulation device adjusts a driving voltage to be applied to the actuator constituting the pump by adjusting an output voltage of a booster circuit. Thus, the liquid circulation device adjusts a liquid feeding capability of the pump.

In the liquid circulation device, when an ink remaining amount in the ink replenishing tank is not detected, there is a case that sufficient ink cannot be supplied to the liquid discharge head. As a result, there is a problem that a discharge failure and temperature rise may occur in the liquid discharge head.

DESCRIPTION OF THE DRAWINGS

FIG. 6 is a diagram illustrating a control of nozzle surface pressure performed by the module controller according to the embodiment.

DETAILED DESCRIPTION

In accordance with an embodiment, a liquid circulation device comprises a booster pump configured to draw liquid from a liquid replenishing tank to supply it to a liquid discharge head; a pressure reducing pump configured to collect the liquid from the liquid discharge head to supply it to the liquid replenishing tank; a buffer tank connected between the liquid discharge head and the booster pump and between the liquid discharge head and the pressure reducing pump, and into which the liquid flows; a pressure sensor configured to detect pressure in the buffer tank; and a processor configured to control driving voltages of the booster pump and the pressure reducing pump based on a nozzle surface pressure of the liquid discharge head calculated based on pressure data detected by the pressure sensor, and to determine whether or not the liquid is deficient based on the nozzle surface pressure, the driving voltage of the booster pump and the driving voltage of the pressure reducing pump.

Hereinafter, a liquid circulation device and a liquid discharge device according to an embodiment are described with reference to the accompanying drawings.

Figure 1:
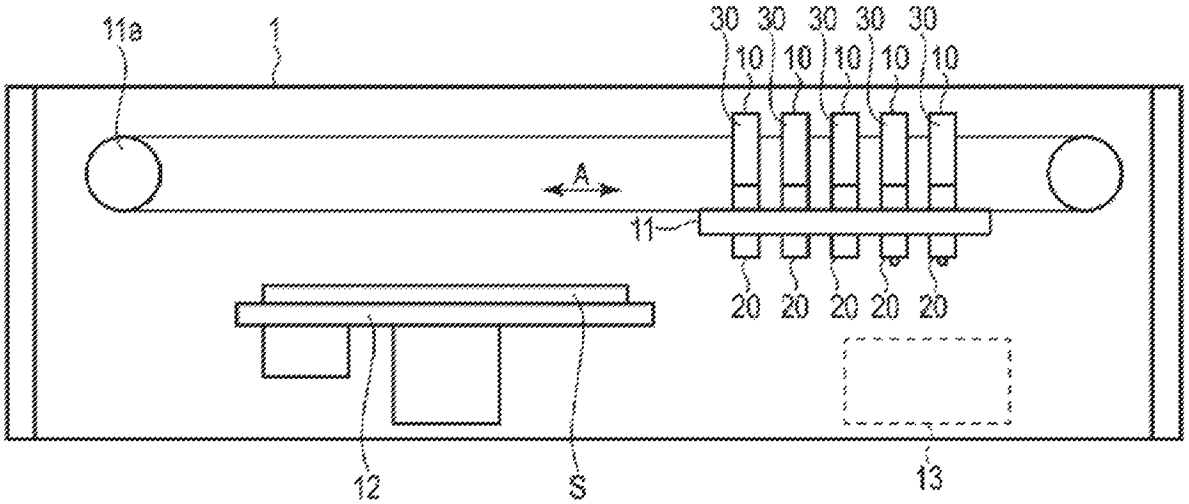
FIG. 1 is a diagram illustrating an example of a configuration of an inkjet recording apparatus according to an embodiment.
Figure 2:
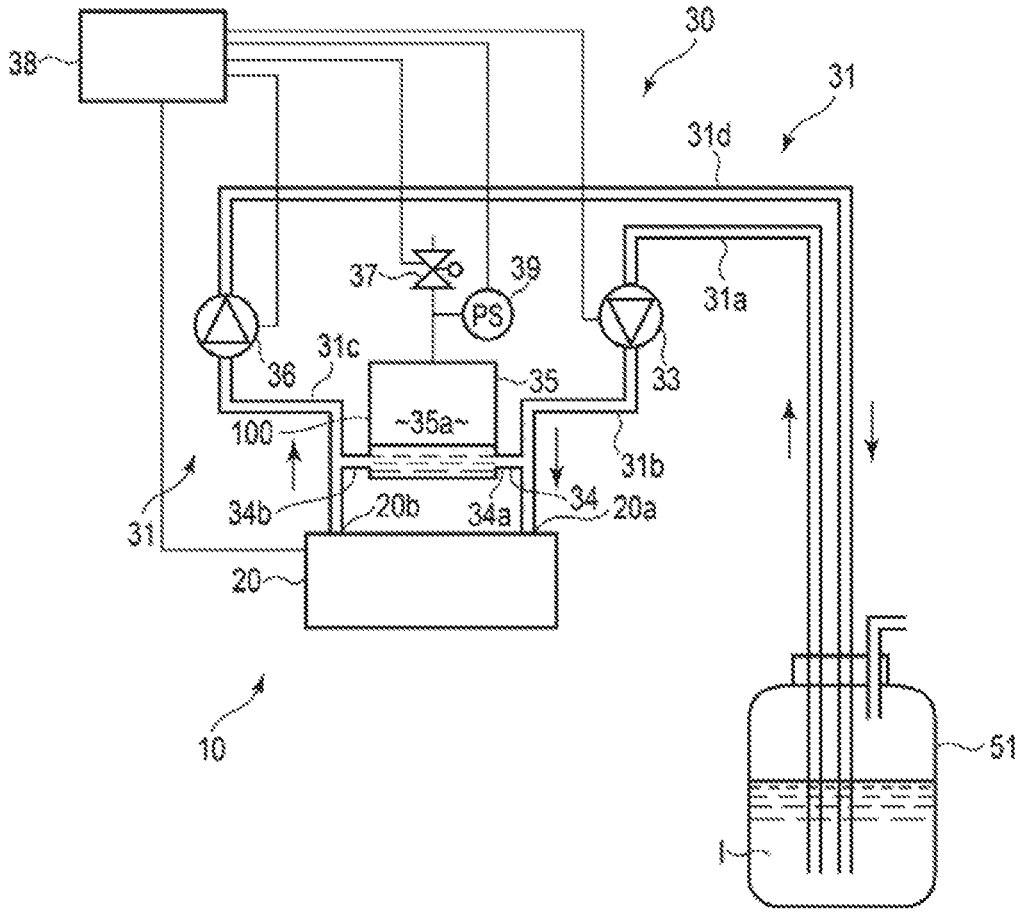
FIG. 2 is a diagram illustrating an example of a configuration of a liquid discharge device according to the embodiment.
Figure 3:
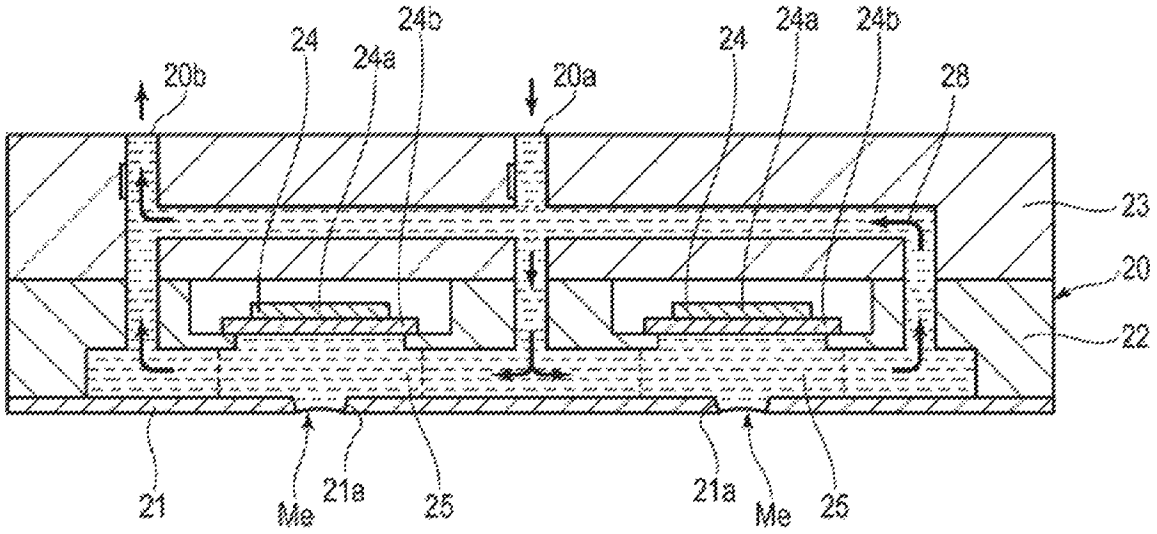
FIG. 3 is a diagram illustrating an example of a configuration of a liquid discharge head according to the embodiment.
Figure 4:
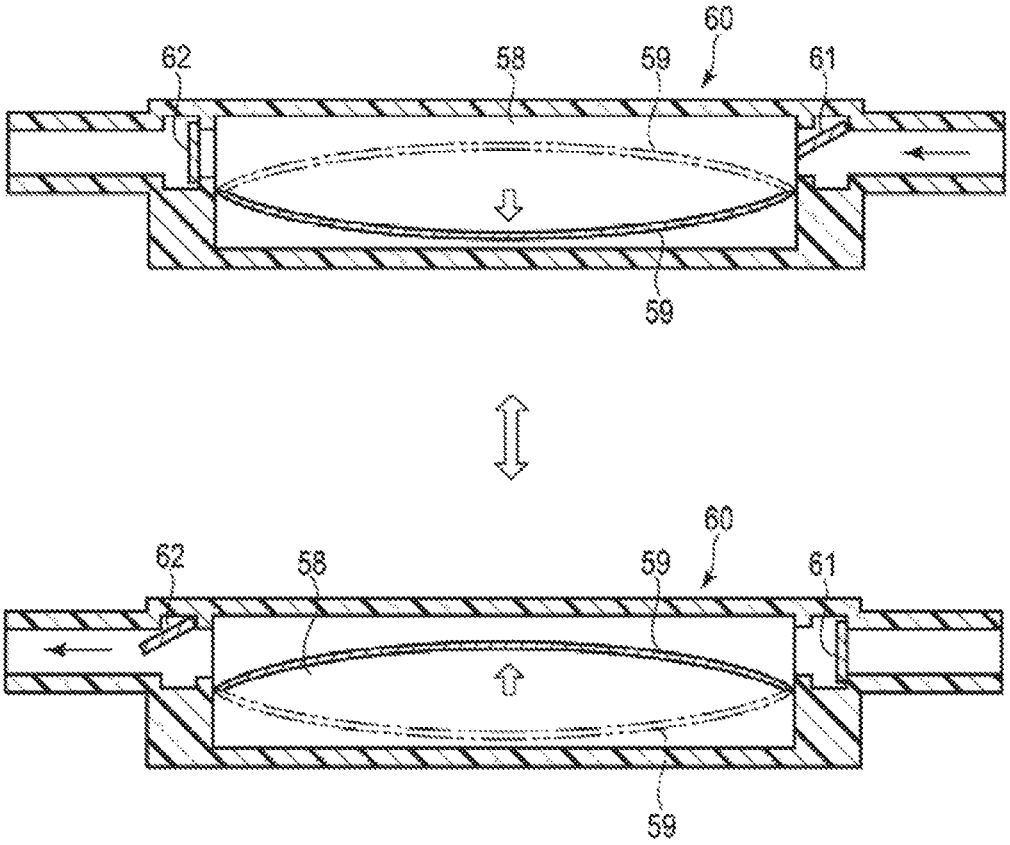
FIG. 4 is a diagram illustrating an example of a configuration of a piezoelectric pump according to the embodiment.

Below, a liquid discharge device 10 and an inkjet recording apparatus 1 including the liquid discharge device 10 according to an embodiment is described with reference to FIG. 1 to FIG. 7. For convenience of description, the configuration is appropriately enlarged, reduced or omitted in each drawing. FIG. 1 is a side view illustrating a configuration of the inkjet recording apparatus 1. FIG. 2 is a diagram illustrating a configuration of the liquid discharge device 10. FIG. 3 is a diagram illustrating a configuration of a liquid discharge head 20. FIG. 4 is a diagram illustrating configurations of a first circulation pump 33 and a second circulation pump 36.

The inkjet recording apparatus 1 shown in FIG. 1 includes a plurality of the liquid discharge devices 10, a head support mechanism 11 for movably supporting the liquid discharge device 10, a medium support mechanism 12 for movably supporting an image receiving medium S and a host control device 13.

As shown in FIG. 1, a plurality of the liquid discharge devices 10 is arranged in parallel in a predetermined direction and is supported by the head support mechanism 11. The liquid discharge device 10 includes a liquid discharge head 20 and a circulation device 30, which are integrated with each other. The liquid discharge device 10 forms a desired image on the image receiving medium S facing the liquid discharge head 10 by discharging, for example, ink I as the liquid from the liquid discharge head 20.

The plurality of the liquid discharge devices 10 discharges ink in a plurality of colors, for example, cyan ink, magenta ink, yellow ink, black ink, and white ink, respectively, but the colors or characteristics of the ink I to be used are not limited. For example, in place of the white ink, transparent glossy ink, special ink that develops color when irradiated with infrared rays or ultraviolet rays, or the like may be discharged. The plurality of the liquid discharge devices 10 has the same configuration although the ink used therein is different.

First, the liquid discharge head 20 is described.

The liquid discharge head 20 shown in FIG. 3 is an inkjet head, and includes a supply port 20*a* into which the ink flows, a collection port 20*b* through which the ink flows out, a nozzle plate 21 having a plurality of nozzle holes 21*a*, a substrate 22, and a manifold 23 bonded to the substrate 22.

The substrate 22 is bonded to face the nozzle plate 21, and is formed into a predetermined shape to form a predetermined ink flow path 28 including a plurality of ink pressure chambers 25 between the nozzle plate 21 and the substrate 22. The substrate 22 has partition walls arranged between the plurality of ink pressure chambers 25 in the same row.

An actuator 24 having electrodes 24*a* and 24*b* is arranged at a portion facing each ink pressure chamber 25 on the substrate 22.

The actuator 24 is arranged to face the nozzle hole 21*a*, and the ink pressure chamber 25 is formed between the actuator 24 and the nozzle hole 21*a*. The actuator 24 is connected to a drive circuit. The liquid discharge head 20 discharges the liquid from the nozzle holes 21*a* facing the actuator 24 by deforming the actuator 24 in response to a voltage under the control of a module controller 38.

Next, the circulation device 30 is described.

As shown in FIG. 2, the circulation device 30 is integrally connected to an upper part of the liquid discharge head 20 by metal connecting components. The circulation device 30 includes a predetermined circulation path 31 configured to be capable of circulating the liquid passing through the liquid discharge head 20, a first circulation pump 33, a bypass flow path 34, a buffer tank 35 as a buffer device 100, the second circulation pump 36, an on-off valve 37 and the module controller 38 for controlling the liquid discharge operation.

The circulation device 30 also has a cartridge 51 as an ink replenishing tank (liquid replenishing tank) provided at the outside of the circulation path 31.

The cartridge 51 is configured to be capable of storing ink, and an air chamber therein is opened to the atmosphere.

First, the circulation path 31 is described.

The circulation path 31 includes a first flow path 31*a*, a second flow path 31*b*, a third flow path 31*c* and a fourth flow path 31*d*. The first flow path 31*a* connects the cartridge 51 which is the ink replenishing tank to the first circulation pump 33. The second flow path 31*b* connects the first circulation pump 33 to the supply port 20*a* of the liquid discharge head 20. The third flow path 31*c* connects the collection port 20*b* of the liquid discharge head 20 to the second circulation pump 36. The fourth flow path 31*d* connects the second circulation pump 36 to the cartridge 51. The first flow path 31*a* and the fourth flow path 31*d* each include a pipe made of metal or resin material, and a tube covering an outer surface of the pipe. The tube covering the outer surface of the pipe of each of the first flow path 31*a* and the fourth flow path 31*d* is, for example, a PTFE (Poly Tetra Fluoroethylene) tube.

The ink circulating through the circulation path 31 passes through the first flow path 31*a*, the first circulation pump 33, the second flow path 31*b*, and the supply port 20*a* of the liquid discharge head 20 from the cartridge 51 to reach the inside of the liquid discharge head 20. The ink circulating through the circulation path 31 passes through the collection port 20*b* of the liquid discharge head 20, the third flow path 31*c*, the second circulation pump 36 and the fourth flow path 31*d* from the liquid discharge head 20 to reach the cartridge 51.

Next, the first circulation pump 33 and the second circulation pump 36 are described.

The first circulation pump 33 is used to feed the liquid. The first circulation pump 33 feeds the liquid from the first flow path 31*a* towards the second flow path 31*b*. Specifically, the first circulation pump 33 is a booster pump which draws the ink from the cartridge 51 which is the ink replenishing tank by the operation of the actuator to supply it to the liquid discharge head 20.

The second circulation pump 36 is used to feed the liquid. The second circulation pump 36 feeds the liquid from the third flow path 31*c* towards the fourth flow path 31*d*. Specifically, the second circulation pump 36 is a pressure reducing pump for collecting the ink from the liquid discharge head 20 by operation of the actuator to supply it to the cartridge 51.

The first circulation pump 33 and the second circulation pump 36 are configured as a piezoelectric pump 60 as shown in FIG. 4, for example. The piezoelectric pump 60 includes a pump chamber 58, a piezoelectric actuator 59 provided in the pump chamber 58 to vibrate when applied with a voltage, and check valves 61 and 62 arranged at an inlet and an outlet of the pump chamber 58. The piezoelectric actuator 59 is capable of vibrating at a frequency of, for example, about 50 Hz to 200 Hz. The first circulation pump 33 and the second circulation pump 36 are connected to the drive circuit by wiring and can operate under the control of the module controller 38.

For example, as the voltage applied to the piezoelectric actuator 59 changes, as shown in the upper and lower drawings of FIG. 4, the piezoelectric actuator 59 is deformed in a direction to contract the pump chamber 58 or in a direction to expand the pump chamber 58. As a result, a volume of the pump chamber 58 changes. For example, when the piezoelectric actuator 59 is deformed in the direction to expand the pump chamber 58, the check valve 61 at the inlet of the pump chamber 58 opens to suck the ink into the pump chamber 58. For example, when the piezoelectric actuator 59 is deformed in the direction to contract the pump chamber 58, the check valve 62 at the outlet of the pump chamber 58 opens to feed the ink in the pump chamber 58 towards the other side. By repeating the operation, the first circulation pump 33 and the second circulation pump 36 suck the ink from one side and feed the ink from the other side.

A maximum change amount of the piezoelectric actuator 59 varies depending on the voltage applied to the piezoelectric actuator 59. If the voltage applied to the piezoelectric actuator 59 increases, the maximum change amount of the piezoelectric actuator 59 increases. If the voltage applied to the piezoelectric actuator 59 decreases, the maximum change amount of the piezoelectric actuator 59 decreases. The liquid feed capability of the piezoelectric pump 60 varies depending on the maximum change amount of the piezoelectric actuator 59. In other words, the module controller 38 controls the liquid feed capability of the piezoelectric pump 60 by controlling the voltage applied to the piezoelectric actuator 59.

Next, the bypass flow path 34 and the buffer tank 35 are described.

The bypass flow path 34 connects the second flow path 31*b* and the third flow path 31*c*. The bypass flow path 34 connects the supply port 20*a* which is a primary side of the liquid discharge head 20 in the circulation path 31 to the collection port 20*b* which is a secondary side of the liquid discharge head 20 through a deficient circuit without using the liquid discharge head 20.

A buffer tank 35 is connected to the bypass flow path 34. Specifically, the bypass flow path 34 includes a first bypass flow path 34*a* connecting a predetermined portion at a lower part of one of the pair of side walls of the buffer tank 35 to the second flow path 31*b*, and a second bypass flow path 34*b* connecting a predetermined portion at a lower part of the other one of the pair of side walls of the buffer tank 35 to the third flow path 31*c*.

For example, the first bypass flow path 34*a* and the second bypass flow path 34*b* have the same length and the same diameter, both of which have smaller diameter than that of the circulation path 31. For example, the diameter of the circulation path 31 is set to about 2 to 5 times the diameter of each of the first bypass flow path 34*a* and the second bypass flow path 34*b*. The first bypass flow path 34*a* and the second bypass flow path 34*b* are arranged in such a manner that a distance between a connection position of the second flow path 31*b* and the first bypass flow path 34*a* and the supply port 20*a* of the liquid discharge head 20 becomes equal to a distance between a connection position of the third flow path 31*c* and the second bypass flow path 34*b* and the collection port 20*b* of the liquid discharge head 20.

The buffer tank 35 has a flow path cross-sectional area larger than that of the bypass flow path 34 to be capable of storing the liquid. The buffer tank 35 has, for example, a rectangular box shape, which has an upper wall, a lower wall, a rear wall, a front wall, and a pair of left and right side walls and includes a storage chamber 35*a* for storing the liquid therein. The connection position of the first bypass flow path 34*a* and the buffer tank 35 and the connection position of the second bypass flow path 34*b* and the buffer tank 35 are set to the same height. At a lower region of the storage chamber 35*a* in the buffer tank 35, the ink flowing through the bypass flow path 34 is stored, and at the upper region of the storage chamber 35*a*, an air chamber is formed. Specifically, the buffer tank 35 can store a predetermined amount of liquid and air. The buffer tank 35 is provided with the on-off valve 37 configured to open the air chamber in the buffer tank 35 to the atmosphere, and a pressure sensor 39.

The on-off valve 37 is a normally closed solenoid on-off valve which is opened when a power supply is turned on and is closed when the power supply is turned off. The on-off valve 37 is opened and closed under the control of the module controller 38 so as to open and close the air chamber of the buffer tank 35 with respect to the atmosphere.

The pressure sensor 39 detects a pressure of the air chamber in the buffer tank 35 and transmits pressure data indicating a value of the pressure to the module controller 38. If the on-off valve 37 is opened and the air chamber of the buffer tank 35 is opened to the atmosphere, the pressure data detected by the pressure sensor 39 has a value equal to atmospheric pressure. The pressure sensor 39 detects the pressure in the air chamber of the buffer tank 35 if the on-off valve 37 is closed and the air chamber of the buffer tank 35 is not open to the atmosphere.

The pressure sensor 39 outputs the pressure as an electric signal using a semiconductor piezoresistive pressure sensor, for example. The semiconductor piezoresistive pressure sensor includes a diaphragm for receiving an external pressure and a semiconductor strain gauge formed on the surface of the diaphragm. The semiconductor piezoresistive pressure sensor detects the pressure by converting the change in the electrical resistance caused by the piezoresistance effect generated in the strain gauge as the diaphragm is deformed due to the external pressure to an electric signal.

Next, the module controller 38 is described.

Figure 5:
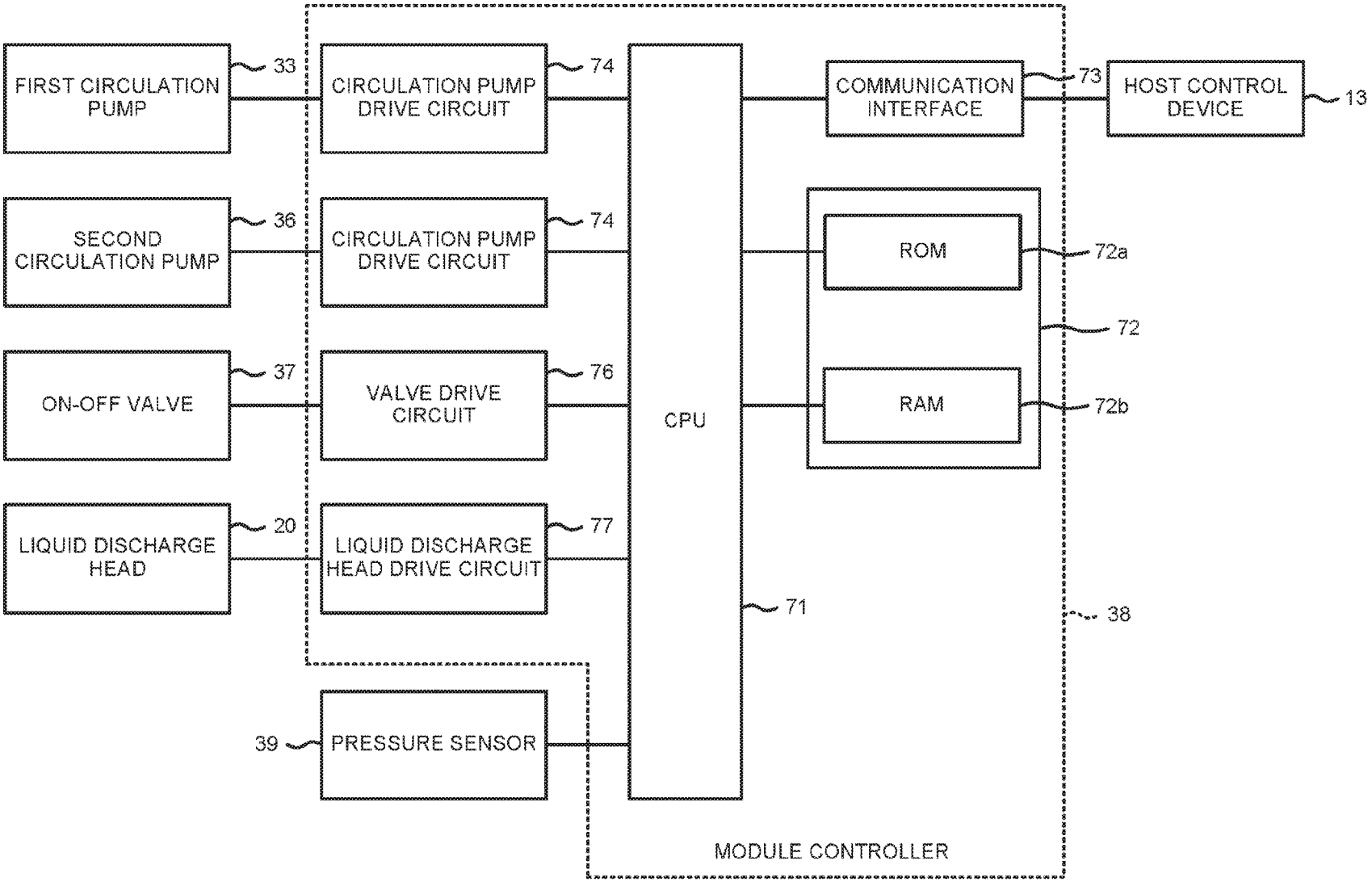
FIG. 5 is a diagram illustrating an example of a configuration of a module controller according to the embodiment.

FIG. 5 is a diagram illustrating an example of a configuration of the module controller 38.

The module controller 38 controls operations of the liquid discharge head 20, the first circulation pump 33, the second circulation pump 36 and the on-off valve 37. The module controller 38 includes a CPU (Central Processing Unit) 71, a memory 72, a communication interface 73, a circulation pump drive circuit 74, a valve drive circuit 76 and a liquid discharge head drive circuit 77.

The CPU 71 is an arithmetic element (e.g., a processor) that executes an arithmetic processing. The CPU 71 performs various processing based on data such as programs stored in the memory 72. By executing the program stored in the memory 72, the CPU 71 functions as a control circuit capable of executing various kinds of control.

The memory 72 stores various kinds of information. The memory 72 includes, for example, a ROM (Read Only Memory) 72*a*, and a RAM (Random Access Memory) 72*b*.

The ROM 72*a* is a read-only nonvolatile memory. The ROM 72*a* stores programs and data used for the programs. For example, the ROM 72*a* stores various setting values such as a calculation formula for calculating ink pressure of the nozzle hole 21*a*, a target pressure range, an adjustment maximum value of each pump and the like as the control data used for the pressure control.

The RAM 72*b* is a volatile memory functioning as a working memory. The RAM 72*b* temporarily stores data being processed by the CPU 71. The RAM 72*b* temporarily stores a program to be executed by the CPU 71.

The communication interface 73 is used for communicating with other devices. The communication interface 73 relays communication with the host control device 13 that transmits print data to the liquid discharge device 10, for example.

Under the control of the CPU 71, the circulation pump drive circuit 74 applies a driving voltage to the piezoelectric actuator 59 of the piezoelectric pump 60 to drive the piezoelectric pump 60. As a result, the circulation pump drive circuit 74 circulates the ink in the circulation path 31. The circulation pump drive circuit 74 is arranged for each circulation pump. The circulation pump drive circuit 74 connected to the first circulation pump 33 applies a driving voltage to the piezoelectric actuator 59 of the first circulation pump 33. The circulation pump drive circuit 74 connected to the second circulation pump 36 applies a driving voltage to the piezoelectric actuator 59 of the second circulation pump 36.

Under the control of the CPU 71, the valve drive circuit 76 drives the on-off valve 37 to open the air chamber of the buffer tank 35 to the atmosphere.

Under the control of the CPU 71, the liquid discharge head drive circuit 77 applies a voltage to the actuator 24 of the liquid discharge head 20 to drive the liquid discharge head 20 to discharge the ink from the nozzle hole 21*a* of the liquid discharge head 20.

In the above configuration, the CPU 71 communicates with the host control device 13 via the communication interface 73 to receive various kinds of information such as an operation condition. Various kinds of information acquired by the CPU 71 are transmitted to the host control device 13 of the inkjet recording apparatus 1 via the communication interface 73.

The CPU 71 acquires a detection result from the pressure sensor 39, and controls the operations of the circulation pump drive circuit 74 and the valve drive circuit 76 based on the acquired detection result. For example, the CPU 71 controls the circulation pump drive circuit 74 based on the detection result of the pressure sensor 39 to control the liquid feed capability of the first circulation pump 33 and the second circulation pump 36. As a result, the CPU 71 adjusts the ink pressure in the nozzle hole 21*a*.

The CPU 71 controls the valve drive circuit 76 to open and close the on-off valve 37. As a result, the CPU 71 adjusts a liquid level of the buffer tank 35.

The CPU 71 acquires the detection result from the pressure sensor 39 and controls the liquid discharge head drive circuit 77 based on the acquired detection result to discharge ink droplets onto an image receiving medium from the nozzle hole 21*a* of the liquid discharge head 20. Specifically, the CPU 71 inputs an image signal corresponding to image data to the liquid discharge head drive circuit 77. The liquid discharge head drive circuit 77 drives the actuator 24 of the liquid discharge head 20 in response to the image signal. If the liquid discharge head drive circuit 77 drives the actuator 24 of the liquid discharge head 20, the actuator 24 is deformed, and the ink pressure (nozzle surface pressure) of the nozzle hole 21*a* facing the actuator 24 changes. The nozzle surface pressure is applied by the ink in the ink pressure chamber 25 to a meniscus Me formed by the ink in the nozzle hole 21*a*. If the nozzle surface pressure exceeds a predetermined value determined according to a shape of the nozzle hole 21*a* and characteristics of the ink, the ink is discharged from the nozzle hole 21*a*. As a result, the CPU 71 forms an image corresponding to the image data on the image receiving medium.

Based on the detection result from the pressure sensor 39, the CPU 71 executes an ink deficiency determination processing of determining whether or not there is a possibility that the ink in the cartridge 51 which is the ink replenishing tank is deficient.

Next, the control of the nozzle surface pressure by the CPU 71 of the module controller 38 is described.

In order to prevent the ink droplet from dripping from the nozzle hole 21*a* of the liquid discharge head 20 when the printing is not performed, the CPU 71 maintains the nozzle surface pressure of the nozzle hole 21*a* of the liquid discharge head 20 at a negative pressure. In the printing, the CPU 71 maintains the nozzle surface pressure (a pressure suitable for maintaining the meniscus Me) suitable for discharging the ink droplet from the nozzle hole 21*a* of the liquid discharge head 20. The CPU 71 controls the liquid feed capability of the first circulation pump 33 and the second circulation pump 36 to control the nozzle surface pressure of the nozzle hole 21*a* of the liquid discharge head 20.

The nozzle surface pressure is increased or decreased by a relative relationship between the liquid feed capability of the first circulation pump 33 and the liquid feed capability of the second circulation pump 36. Specifically, when the liquid feed capability of the first circulation pump 33 is stronger than that of the second circulation pump 36, the nozzle surface pressure is increased. When the liquid feed capability of the first circulation pump 33 is weaker than that of the second circulation pump 36, the nozzle surface pressure is decreased.

FIG. 6 is a diagram illustrating a control of the nozzle surface pressure by the CPU 71 of the module controller 38.

In Act 1, the CPU 71 stands by until an instruction to start circulation is received. For example, if the instruction to start circulation is detected from a command from the host control device 13 (Yes in Act 1), the flow proceeds to the processing in Act 2. In a printing operation, the host control device 13 performs an ink discharging operation while reciprocating the liquid discharge device 10 in a direction orthogonal to a conveyance direction of the image receiving medium S to form an image on the image receiving medium S. Specifically, the CPU 71 conveys a carriage 11*a* provided in the head support mechanism 11 in a direction towards the image receiving medium S and reciprocates it in a direction indicated by an arrow A. The CPU 71 supplies the image signal corresponding to the image data to the liquid discharge head drive circuit 77 to drive the actuator 24 of the liquid discharge head 20 in response to the image signal to discharge the ink droplet onto the image receiving medium S from the nozzle hole 21*a*.

In Act 2, the CPU 71 drives the first circulation pump 33 and the second circulation pump 36 to start the ink circulation operation. The ink circulating through the circulation path 31 passes through the first flow path 31*a*, the first circulation pump 33, the second flow path 31*b*, and the supply port 20*a* of the liquid discharge head 20 from the cartridge 51 to reach the inside of the liquid discharge head 20. The ink circulating through the circulation path 31 passes through the collection port 20*b* of the liquid discharge head 20, the third flow path 31*c*, the second circulation pump 36, and the fourth flow path 31*d* from the liquid discharge head 20 to reach the cartridge 51.

In Act 3, the CPU 71 detects the pressure data of the buffer tank 35 transmitted from the pressure sensor 39.

In Act 4, the CPU 71 detects the ink pressure of the nozzle from the pressure data. Specifically, based on the pressure data of the buffer tank 35 transmitted from the pressure sensor 39, the CPU 71 calculates the ink pressure of the nozzle hole 21*a* using a predetermined calculation formula.

First, if the density of the ink is p, an acceleration of gravity is g, and a distance in a height direction between a liquid surface of the ink in the buffer tank 35 and the nozzle surface is h, the pressure generated by a water head difference between the height of the liquid surface of the ink in the buffer tank 35 and the height of the nozzle surface is pgh. For example, the CPU 71 calculates ink pressure (nozzle surface pressure) Pn in the nozzle by adding the pressure pgh to the pressure data of the buffer tank 35 transmitted from the pressure sensor 39.

By performing the comparison based on the calculated nozzle surface pressure Pn, the CPU 71 controls the driving voltage to be applied to the piezoelectric actuator 59 of the first circulation pump 33 and the driving voltage to be applied to the piezoelectric actuator 59 of the second circulation pump to control the liquid feed capability of the first circulation pump 33 and the second circulation pump 36. As a result, the CPU 71 performs control so that the nozzle surface pressure Pn becomes an appropriate value.

The CPU 71 acquires a target pressure range of the nozzle surface pressure Pn from the ROM 72*a*. The target pressure range may be one value, or may be a range having an upper limit value and a lower limit value. The CPU 71 may sequentially acquire the target pressure ranges from the host terminal 13 via the communication interface 73. In the present embodiment, the target pressure range is described as one value (target pressure).

First, in Act 5, the CPU 71 determines whether or not the nozzle surface pressure Pn is smaller than the target pressure.

If it is determined that the nozzle surface pressure Pn is smaller than the target pressure (Yes in Act 5), the CPU 71 determines whether or not the driving voltage of the booster pump reaches the adjustment maximum value in Act 6. Specifically, the CPU 71 determines whether or not the driving voltage applied to the piezoelectric actuator 59 of the first circulation pump 33 which is the booster pump reaches the maximum value (adjustment maximum value) of the driving voltage at which the piezoelectric actuator 59 can operate.

If it is determined that the driving voltage of the first circulation pump 33 reaches the adjustment maximum value (Yes in Act 6), the CPU 71 lowers the driving voltage of the second circulation pump 36 which is the pressure reducing pump in Act 7. In other words, the CPU 71 lowers the liquid feed capability of the second circulation pump 36. As a result, the nozzle surface pressure Pn is increased.

If it is determined that the driving voltage of the first circulation pump 33 does not reach the adjustment maximum value (No in Act 6), the CPU 71 raises the driving voltage of the first circulation pump 33 in Act 8. In other words, the CPU 71 increases the liquid feed capability of the first circulation pump 33. As a result, the nozzle surface pressure Pn is increased.

If it is determined that the nozzle surface pressure Pn is equal to or higher than the target pressure (No in Act 5), in Act 9, the CPU 71 determines whether or not the nozzle surface pressure Pn is larger than the target pressure.

If it is determined that the nozzle surface pressure Pn is larger than the target pressure (Yes in Act 9), the CPU 71 determines whether or not the driving voltage of the pressure reducing pump reaches the adjustment maximum value in Act 10. Specifically, the CPU 71 determines whether or not the driving voltage applied to the piezoelectric actuator 59 of the second circulation pump 36 which is the pressure reducing pump reaches the maximum value at which the piezoelectric actuator 59 can operate.

If it is determined that the driving voltage of the pressure reducing pump reaches the adjustment maximum value (Yes in Act 10), the CPU 71 lowers the driving voltage of the first circulation pump 33 in Act 11. In other words, the CPU 71 lowers the liquid feed capability of the first circulation pump 33. As a result, the nozzle surface pressure Pn is decreased.

If it is determined that the driving voltage of the pressure reducing pump does not reach the adjustment maximum value (No in Act 10), the CPU 71 raises the driving voltage of the second circulation pump 36 in Act 12. In other words, the CPU 71 increases the liquid feed capability of the second circulation pump 36. As a result, the nozzle surface pressure Pn is decreased.

If the driving voltage of the second circulation pump 36 is lowered in Act 7, if the driving voltage of the first circulation pump 33 is raised in Act 8, if the driving voltage of the first circulation pump 33 is lowered in Act 11, or if the driving voltage of the second circulation pump 36 is raised in Act 12, the CPU 71 performs the ink deficiency determination processing in Act 13. If it is determined that the nozzle surface pressure Pn is not larger than the target pressure (No in Act 9), the CPU 71 proceeds to the processing in Act 14. Alternatively, if it is determined that the nozzle surface pressure Pn is not larger than the target pressure (No in Act 9), the CPU 71 may proceed to the processing in Act 13.

After executing the ink deficiency determination processing, the CPU 71 determines whether or not a circulation termination command is received from the host terminal 13 in Act 14.

If the CPU 71 does not receive the circulation termination command from the host terminal 13 (No in Act 14), the CPU 71 proceeds to the processing in Act 3. Then, the CPU 71 repeatedly executes the processing in Act 3 to Act 13 until the circulation termination command is received. As a result, the CPU 71 sequentially performs control so that the nozzle surface pressure Pn becomes the target pressure.

If receiving the circulation termination command from the host terminal 13 (Yes in Act 14), the CPU 71 terminates the ink circulation operation in Act 15. Specifically, the CPU 71 stops the operations of the first circulation pump 33 and the second circulation pump 36 by stopping the operation of the circulation pump drive circuit 74. As a result, the circulation of the ink between the cartridge 51 and the circulation path 31 is completed.

Next, the ink deficiency determination processing in Act 13 in FIG. 6 is described.

If the ink is reduced in the cartridge 51, there is a possibility that air bubbles may enter the first flow path 31*a*. This is because the tube constituting the first flow path 31*a* is exposed to the atmosphere as the liquid surface of the ink in the cartridge 51 lowers. In this way, when air bubbles enter the circulation path 31, the nozzle surface pressure Pn in the liquid discharge head 20 increases. Therefore, the CPU 71 determines whether or not the ink is deficient based on the change in the nozzle surface pressure Pn.

According to the processing in FIG. 6, if the nozzle surface pressure Pn increases and becomes larger than the target pressure, the CPU 71 first performs control to increase the driving voltage of the second circulation pump 36 to reduce the nozzle surface pressure Pn. Next, when the driving voltage of the second circulation pump 36 reaches the adjustment maximum value, the CPU 71 performs control to lower the nozzle surface pressure Pn by lowering the driving voltage of the first circulation pump 33. If the nozzle surface pressure Pn is still larger than the target pressure even if the driving voltage of the first circulation pump 33 is lowered, the CPU 71 lowers the driving voltage of the first circulation pump 33 to the minimum value (adjustment minimum value) of the driving voltage at which the piezoelectric actuator 59 can operate. For example, if the nozzle surface pressure Pn is still larger than the target pressure even if the driving voltage of the first circulation pump 33 is lowered to the adjustment minimum value, it is estimated that air bubbles may enter the circulation path 31. In other words, the CPU 71 determines whether or not the ink is deficient.

Figure 7:
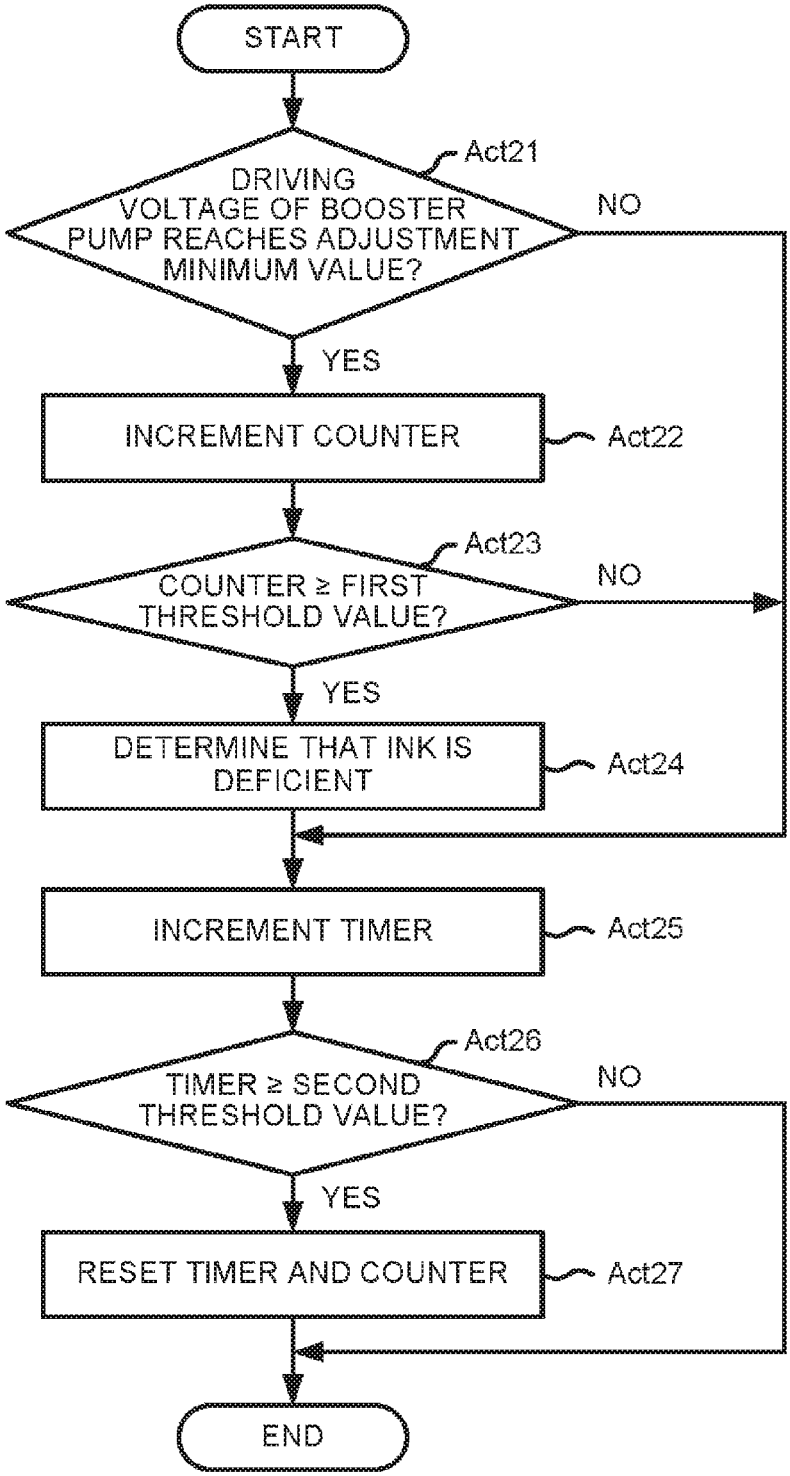
FIG. 7 is a diagram illustrating an ink deficiency determination processing according to the embodiment.

The CPU 71 executes the ink deficiency determination processing shown in FIG. 7 to determine whether or not the ink is deficient.

FIG. 7 is a diagram illustrating an example of the ink deficiency determination processing shown in FIG. 7.

First, in Act 21, the CPU 71 determines whether or not the driving voltage of the first circulation pump 33 which is the booster pump reaches the adjustment minimum value.

If it is determined that the driving voltage of the first circulation pump 33 reaches the adjustment minimum value (Yes in Act 21), the CPU 71 increments a counter in Act 22. Specifically, the CPU 71 counts the number of times that the driving voltage of the first circulation pump 33 reaches the adjustment minimum value. For example, the CPU 71 uses a predetermined area on the RAM 72*b* as a counter. Specifically, if it is determined that the driving voltage of the first circulation pump 33 reaches the adjustment minimum value, the CPU 71 increments a value in a predetermined area on the RAM 72*b* by 1.

In Act 23, the CPU 71 determines whether or not a value of the counter is equal to or greater than a preset first threshold value. The first threshold value may be transmitted from the host terminal 13 and stored in the RAM 72*b* or may be stored in the ROM 72*a*.

If it is determined that the value of the counter is less than the preset first threshold value (No in Act 23), or if it is determined that the driving voltage of the first circulation pump 33 does not reach the adjustment minimum value (No in Act 21), the CPU 71 proceeds to the processing in Act 25.

If it is determined that the value of the counter is equal to or greater than the preset first threshold value (Yes in Act 23), the CPU 71 determines that the ink is deficient in Act 24, and proceeds to the processing in Act 25. Furthermore, the CPU 71 may transmit a message indicating that the ink is deficient to the host terminal 13 via the communication interface 73. If the inkjet recording apparatus 1 includes a speaker, the CPU 71 may output a sound from the speaker to indicate that the ink is deficient. If the inkjet recording apparatus 1 includes a display, the CPU 71 may display a message indicating that the ink is deficient on the display.

The CPU 71 may stop the printing operation by stopping the operation of the liquid discharge head drive circuit 77.

The CPU 71 increments a timer in Act 25. For example, the CPU 71 uses a predetermined area on the RAM 72*b* as a timer. For example, the CPU 71 increments a value of the predetermined area on the RAM 72*b* by 1.

In Act 26, the CPU 71 determines whether or not the value of the timer is equal to or greater than a preset second threshold value. The second threshold value may be transmitted from the host terminal 13 and stored in the RAM 72*b* or may be stored in the ROM 72*a*.

If it is determined that the value of the timer is less than the preset second threshold value (No in Act 26), the CPU 71 terminates the ink deficiency determination processing. In this case, the value of the timer and the value of the counter are maintained.

If it is determined that the value of the timer is equal to or greater than the preset second threshold value (Yes in Act 26), the CPU 71 resets the timer and the counter in Act 27 and then terminates the ink deficiency determination processing. Specifically, the CPU 71 sets the values of the area corresponding to the counter on the RAM 72*b* and the area corresponding to the timer to 0.

As shown in FIG. 6, the CPU 71 repeatedly executes the ink deficiency determination processing until the circulation termination command is received. If the number of times that the driving voltage of the first circulation pump 33 reaches the adjustment minimum value is equal to or greater than the first threshold value within a certain time interval determined by the second threshold value, the CPU 71 determines that the ink of the cartridge 51 which is the ink replenishing tank is deficient. Specifically, the first threshold value is set to 5 times, and the second threshold value is set to 100 ms. In this case, the CPU 71 determines that the ink in the cartridge 51 is deficient when the number of times the driving voltage of the first circulation pump 33 reaches the adjustment minimum value is five or more within 100 ms.

When the target pressure is changed via the communication interface 73, the CPU 71 may not execute the ink deficiency determination processing in Act 13 while the pressure reaches "target pressure ±0.01 kPa" or until a predetermined period of time (e.g., 10 seconds) elapses since the target pressure is changed.

The circulation device 30 configured as described above comprises the first circulation pump 33 that draws the ink from the cartridge 51 which is the ink replenishing tank to supply it to the liquid discharge head 20, the second circulation pump 36 configured to collect the ink from the liquid discharge head 20 to supply it to the cartridge 51, the buffer tank 35 between the liquid discharge head 20 and the first circulation pump 33 and between the liquid discharge head 20 and the second circulation pump 36 and into which the ink flows, the pressure sensor 39 configured to detect the pressure in the buffer tank 35, and the CPU 71. The CPU 71 controls the driving voltages of the first circulation pump 33 and the second circulation pump 36 based on the nozzle surface pressure of the liquid discharge head 20 calculated based on the pressure data detected by the pressure sensor 39. Based on the nozzle surface pressure, the driving voltage of the first circulation pump 33 and the driving voltage of the second circulation pump 36, the CPU 71 determines whether or not the ink is deficient.

Specifically, based on the nozzle surface pressure, the driving voltage of the first circulation pump 33 and the driving voltage of the second circulation pump 36, the CPU 71 determines whether or not the ink is deficient by determining whether or not air bubbles enter the circulation path 31 in which the ink are circulated by the first circulation pump 33 and the second circulation pump 36. In this manner, the circulation device 30 can detect the deficiency of the ink in the external cartridge 51 without adding a configuration for detecting the deficiency of the ink in the external cartridge 51.

The CPU 71 determines that the ink is deficient if the number of times that the nozzle surface pressure is higher than the preset target pressure, that the driving voltage of the second circulation pump 36 reaches the maximum value, or that the driving voltage of the first circulation pump 33 reaches the minimum value is equal to or greater than a preset number of times within a preset time interval. Thus, even if the nozzle surface pressure is not stabilized, i.e., in a state in which there is lots of noise, the CPU 71 can appropriately determine whether or not the air bubbles enter the circulation path 31.

In the above embodiment, the CPU 71 determines that the ink is deficient if the number of times that the nozzle surface pressure is higher than the preset target pressure, that the driving voltage of the second circulation pump 36 reaches the maximum value, or that the driving voltage of the first circulation pump 33 reaches the minimum value is equal to or greater than the preset number of times within a preset time interval; however, it is not limited thereto. The CPU 71 may determine that the ink is deficient simply when the nozzle surface pressure is higher than the preset target pressure, the driving voltage of the second circulation pump 36 reaches the maximum value or the driving voltage of the first circulation pump 33 reaches the minimum value.

The CPU 71 may determine that the ink is deficient when the nozzle surface pressure increases while the driving voltage of the second circulation pump 36 and the driving voltage of the first circulation pump 33 are not changed. In other words, the CPU 71 may determine that the ink is deficient when the nozzle surface pressure increases while the liquid feed capability of the circulation pump does not change.

The CPU 71 determines that the ink is deficient when the number of times the driving voltage of the first circulation pump 33 reaches the minimum value is equal to or greater than the first threshold value within the time interval defined by the second threshold value; however, it is not limited thereto. The CPU 71 may determine that the ink is deficient when the number of times the driving voltage of the first circulation pump 33 reaches the minimum value within a predetermined period of time in the past is equal to or greater than the first threshold value. In this case, the CPU 71 stores a timer stamp in the RAM 72*b* if it is determined that the nozzle surface pressure is greater than the preset target pressure, the driving voltage of the second circulation pump 36 reaches the maximum value, and the driving voltage of the first circulation pump 33 reaches the minimum value. The CPU 71 may determine that the ink is deficient when the number of time stamps within the predetermined period of time in the past is equal to or greater than the first threshold value.

In the above embodiment, the pressure sensor 39 detects the pressure in the air chamber of the buffer tank 35, but it is not limited thereto. The pressure sensor 39 may detect each of the pressure in the second flow path 31*b* and the pressure in the third flow path 31*c*, and transmit an average value thereof to the module controller 38.

The liquid to be discharged is not limited to the ink for printing but may be liquid containing conductive particles for forming a wiring pattern of a printed wiring substrate or the like.

In addition to the above, for example, the liquid discharge head may discharge ink droplets by deforming the diaphragm with static electricity, or discharge ink droplets from the nozzle using thermal energy from a heater or the like.

In the above embodiment, the liquid discharge head is used in the inkjet recording apparatus and the like, but it is not limited thereto. For example, the liquid discharge head may be applicable to a 3D printer, an industrial manufacturing machine, medical applications or the like.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A liquid circulation device, comprising:

a booster pump configured to draw liquid from a liquid replenishing tank and to supply the liquid to a liquid discharge head;

a pressure reducing pump configured to collect the liquid from the liquid discharge head and to supply the liquid to the liquid replenishing tank;

a buffer tank connected between the liquid discharge head and the booster pump and between the liquid discharge head and the pressure reducing pump, and into which the liquid flows;

a pressure sensor configured to detect pressure in the buffer tank; and a processor configured to control driving voltages of the booster pump and the pressure reducing pump based on a nozzle surface pressure of the liquid discharge head calculated based on pressure data detected by the pressure sensor, and to determine whether or not the liquid is deficient based on the nozzle surface pressure, the driving voltage of the booster pump, and the driving voltage of the pressure reducing pump.

2. The liquid circulation device according to claim 1, wherein the processor determines that the liquid is deficient if the nozzle surface pressure is greater than a preset target pressure, the driving voltage of the pressure reducing pump reaches a maximum value, or the driving voltage of the booster pump reaches a minimum value.

3. The liquid circulation device according to claim 1, wherein the processor determines that the liquid is deficient if a number of times that the nozzle surface pressure is greater than a preset target pressure, that the driving voltage of the pressure reducing pump reaches a maximum value, or that the driving voltage of the booster pump reaches a minimum value is equal to or greater than a preset number of times within a preset time interval.

4. The liquid circulation device according to claim 1, wherein if the nozzle surface pressure increases while the driving voltage of the pressure reducing pump and the driving voltage of the booster pump are not changed, the processor determines that the liquid is deficient.

5. The liquid circulation device according to claim 1, wherein the processor determines that the liquid is not deficient if the nozzle surface pressure is lower than a preset target pressure, the driving voltage of the pressure reducing pump does not reach a maximum value, or the driving voltage of the booster pump does not reach a minimum value.

6. The liquid circulation device according to claim 1, wherein the processor determines that the liquid is not deficient if a number of times that the nozzle surface pressure is greater than a preset target pressure, that the driving voltage of the pressure reducing pump reaches a maximum value, or that the driving voltage of the booster pump reaches a minimum value is less than a preset number of times within a preset time interval.

7. The liquid circulation device according to claim 1, wherein if the nozzle surface pressure decreases while the driving voltage of the pressure reducing pump and the driving voltage of the booster pump are not changed, the processor determines that the liquid is not deficient.

8. A liquid discharge device, comprising:

a liquid discharge head configured to discharge liquid;

a booster pump configured to draw liquid from a liquid replenishing tank and to supply the liquid to the liquid discharge head;

a pressure reducing pump configured to collect the liquid from the liquid discharge head and to supply the liquid to the liquid replenishing tank;

a buffer tank connected between the liquid discharge head and the booster pump and between the liquid discharge head and the pressure reducing pump, and into which the liquid flows;

a pressure sensor configured to detect pressure in the buffer tank; and a processor configured to control driving voltages of the booster pump and the pressure reducing pump based on a nozzle surface pressure of the liquid discharge head calculated based on pressure data detected by the pressure sensor, and to determine whether or not the liquid is deficient based on the nozzle surface pressure, the driving voltage of the booster pump, and the driving voltage of the pressure reducing pump.

9. The liquid discharge device according to claim 8, wherein the processor determines that the liquid is deficient if the nozzle surface pressure is greater than a preset target pressure, the driving voltage of the pressure reducing pump reaches a maximum value, or the driving voltage of the booster pump reaches a minimum value.

10. The liquid discharge device according to claim 8, wherein the processor determines that the liquid is deficient if a number of times that the nozzle surface pressure is greater than a preset target pressure, that the driving voltage of the pressure reducing pump reaches a maximum value, or that the driving voltage of the booster pump reaches a minimum value is equal to or greater than a preset number of times within a preset time interval.

11. The liquid discharge device according to claim 8, wherein if the nozzle surface pressure increases while the driving voltage of the pressure reducing pump and the driving voltage of the booster pump are not changed, the processor determines that the liquid is deficient.

12. The liquid discharge device according to claim 8, wherein the processor determines that the liquid is not deficient if the nozzle surface pressure is lower than a preset target pressure, the driving voltage of the pressure reducing pump does not reach a maximum value, or the driving voltage of the booster pump does not reach a minimum value.

13. The liquid discharge device according to claim 8, wherein the liquid is inkjet printing ink.

14. The liquid discharge device according to claim 8, wherein the liquid discharge device is an inkjet head.

15. A liquid circulation method, comprising:

drawing liquid from a liquid replenishing tank and supplying the liquid to a liquid discharge head;

collecting the liquid from the liquid discharge head and supplying the liquid to the liquid replenishing tank;

flowing the liquid into a buffer tank connected between the liquid discharge head and the booster pump and between the liquid discharge head and the pressure reducing pump;

detecting pressure in the buffer tank;

a processor configured to controlling driving voltages that control drawing, supplying, and collecting the liquid based on a nozzle surface pressure of the liquid discharge head calculated based on the pressure detected; and determining whether or not the liquid is deficient based on the nozzle surface pressure, the driving voltage of drawing and supplying, and the driving voltage of collecting and supplying.

16. The liquid circulation method according to claim 15, wherein determining that the liquid is deficient if the nozzle surface pressure is greater than a preset target pressure, the driving voltage of collecting and supplying reaches a maximum value, or the driving voltage of drawing and supplying reaches a minimum value.

17. The liquid circulation method according to claim 15, wherein determining that the liquid is deficient if a number of times that the nozzle surface pressure is greater than a preset target pressure, that the driving voltage of collecting and supplying reaches a maximum value, or that the driving voltage of drawing and supplying reaches a minimum value is equal to or greater than a preset number of times within a preset time interval.

18. The liquid circulation method according to claim 15, wherein if the nozzle surface pressure increases while the driving voltage of collecting and supplying and the driving voltage of drawing and supplying are not changed, determining that the liquid is deficient.

19. The liquid circulation method according to claim 15, wherein determining that the liquid is not deficient if the nozzle surface pressure is lower than a preset target pressure, the driving voltage of collecting and supplying does not reach a maximum value, or the driving voltage of drawing and supplying does not reach a minimum value.

20. The liquid circulation method according to claim 15, wherein determining that the liquid is not deficient if a number of times that the nozzle surface pressure is greater than a preset target pressure, that the driving voltage of collecting and supplying reaches a maximum value, or that the driving voltage of drawing and supplying reaches a minimum value is less than a preset number of times within a preset time interval.

* * * * *